US005973270A

United States Patent [19]

Keller

[11] Patent Number: 5,973,270

[45] Date of Patent: Oct. 26, 1999

[54] WELLBORE CABLE PROTECTOR

[75] Inventor: Marvin A. Keller, Bartlesville, Okla.

[73] Assignee: Camco International, Inc., Houston, Tex.

[21] Appl. No.: 08/876,823

[22] Filed: Jun. 16, 1997

[51] Int. Cl.[6] ..... H01B 7/24

[52] U.S. Cl. ..... 174/136; 405/157

[58] Field of Search ..... 174/136; 285/24, 285/119; 248/49; 405/154, 157

[56] References Cited

U.S. PATENT DOCUMENTS 2,829,190 4/1958 Comlossy, Jr. ..... 174/136
2,858,093 10/1958 Knoll ..... 248/49
3,048,358 8/1962 Raulins et al. ..... 248/49
3,171,889 3/1965 McCarthy ..... 174/136
4,337,969 7/1982 Escaron et al. ..... 285/24

*Primary Examiner*—Nestor Ramirez
*Assistant Examiner*—Joseph Waks

[57] ABSTRACT

A cable protector for use within a wellbore has at least one housing member adapted to be placed against a wellbore device, such as an electric submergible pumping system. The housing member has at least one and preferably two longitudinal protrusions extending therefrom, which are adapted to receive an electric power cable adjacent to or between the protrusions. One or more bands or straps extend around the housing member to attach the cable protector to the wellbore device and to retain the cable between and inwardly of the protrusions.

11 Claims, 4 Drawing Sheets

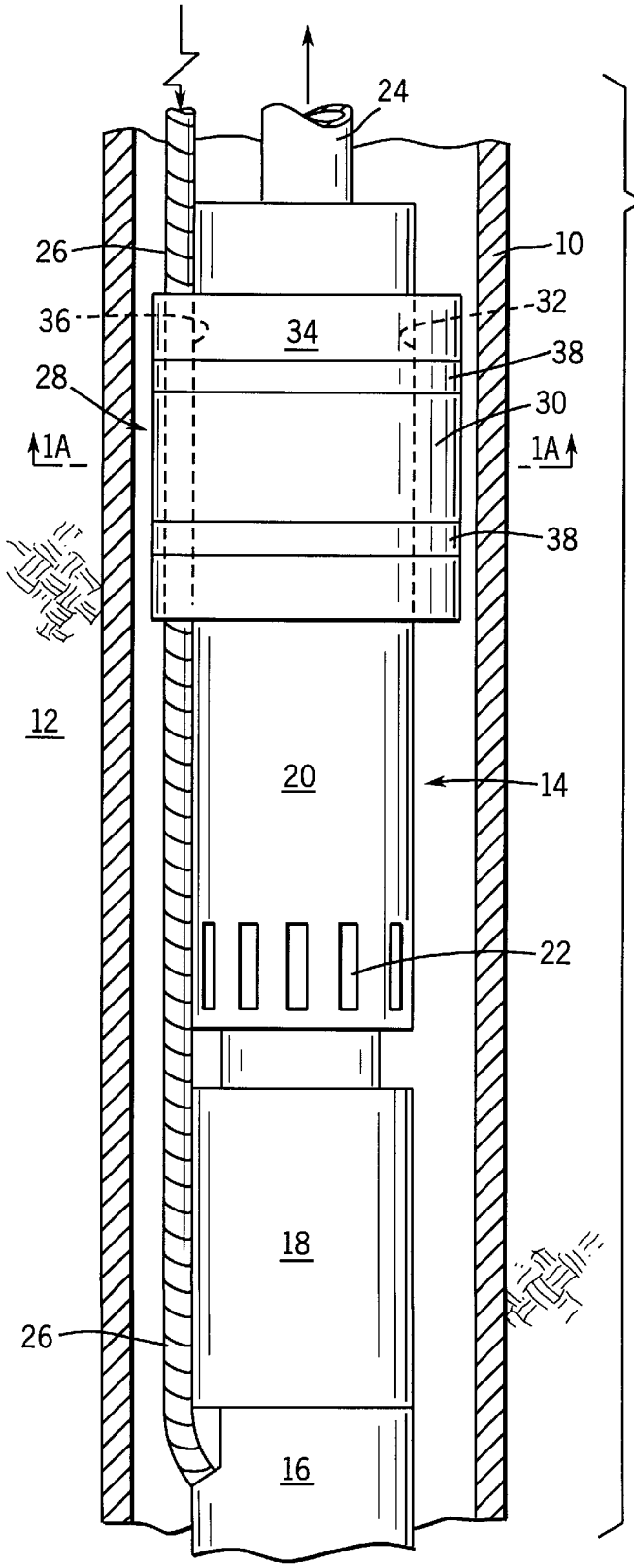
FIG. 1
FIG. 1A
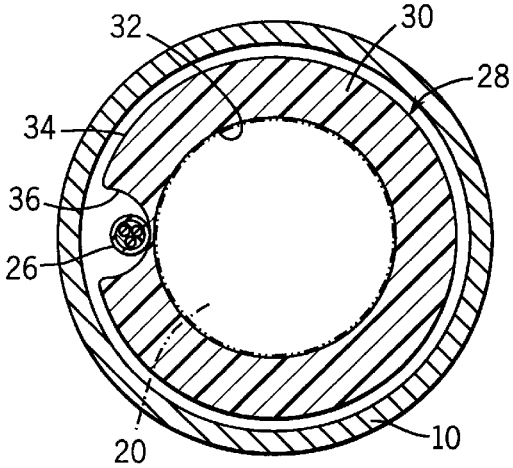

WELLBORE CABLE PROTECTOR

BACKGROUND OF THE INVENTION

1. Field of the Invention

The present invention relates to devices used to protect a cable that is disposed within a wellbore and, more particularly, to a cable protector used to protect an electric power cable connected to an electric submergible pumping system within a wellbore.

2. Description of Related Art

Wellbore cable anchors and protectors are mechanical devices that are bolted to or strapped around a wellbore conduit, and include openings therein for a cable or other conduit to pass therethrough. The purpose of such cable protectors is to rigidly hold the cable to transfer its weight to the wellbore conduit. These devices are needed because wellbore cables generally cannot support their own weight past about 200 feet of suspension. Another purpose of such cable protectors is to prevent the cable from moving within the wellbore, with such movement causing abrasion or impact damage to the cable. Due to their need to transfer the weight of the cable to the wellbore conduit, the prior cable anchors and protectors include relatively large forged or cast housings, with robust clamps and/or bolts.

In certain wellbore applications, there exists very close clearances between an exterior surface of the electric submergible pumping system and an interior surface of the wellbore casing. This is especially true where the power cable must pass a progressive cavity pump and at least an upper portion of a submergible motor. In these applications, there is a need to protect the cable from being damaged by its movement and/or impact from vibrating or moving wellbore equipment, and not as much of a need at that point to transfer the weight of the cable to the wellbore conduit. These dimensions are often too close to permit the use of the prior robust cable anchors and protectors; therefore, there is a need for a simple cable protector which can be used in wellbore applications with very close clearances and which provide vibration dampening.

SUMMARY OF THE INVENTION

The present invention has been contemplated to overcome the foregoing deficiencies and meet the above described needs. Specifically, the present invention is a cable protector for use within a wellbore, and includes at least one housing member adapted to be placed against a wellbore device, such as an electric submergible pumping system. The housing member has at least one and preferably two longitudinal protrusions extending therefrom, which are adapted to receive an electric power cable adjacent to or between the protrusions. One or more bands or straps extend around the housing member to attach the cable protector to the wellbore device and to retain the cable between and inwardly of the protrusions. If the cable protector is made from elastomeric material, then it can provide the desired vibration dampening.

BRIEF DESCRIPTION OF THE DRAWINGS

FIG. 1 is a longitudinal, partial cut-away view of an electric submergible pumping system suspended within a wellbore, with one preferred embodiment of a cable protector of the present invention shown attached to the pumping system.

FIG. 1A is a cross-sectional view taken generally along line 1A—1A of FIG. 1.

DETAILED DESCRIPTION OF THE PREFERRED EMBODIMENTS

Figure 2:
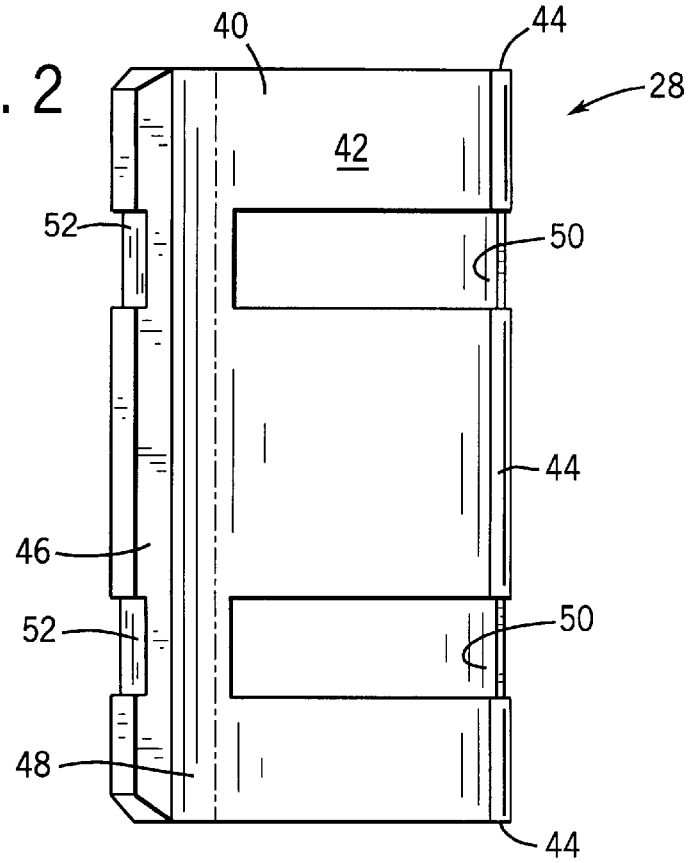
FIG. 2 is a side elevational view of an alternate preferred embodiment of a cable protector of the present invention.

As discussed briefly above, the present invention is a cable protector for use with an electric submergible pumping system, yet the protectors of the present invention can be used to restrain and protect conduits for use with other downhole equipment, such as Measurement While Drilling (MWD) equipment, logging equipment, downhole production completion equipment, subsurface safety valves, downhole pumping equipment, gas lift equipment, downhole steam generators, and the like. In addition, the protectors can be used to restrain and protect one or more conduits, cables, wires or ropes, including but not limited to fiber optics, hydraulic control lines, and the like, for providing power to or from downhole equipment, as well as for providing communications to and from or conveying and retrieving downhole equipment.

To better understand the present invention, reference will be made to the accompanying drawings. In FIG. 1, a wellbore casing 10 penetrates one or more subterranean earthen formations 12. Suspended within the casing 10 is a wellbore device 14, such as any of the wellbore devices discussed above. For ease of understanding, hereinafter, the wellbore device 14 will be referred to as an electric submergible pumping system or "ESP". A typical ESP 14 comprises an electric motor 16, an oil-filled motor protector 18, and one or more pumps 20. The pump 20 can be a multistage centrifugal pump, a gear pump, a vane pump, a progressive cavity pump, and the like. Fluids entering the casing 10 from the subterranean formations 12 pass the motor 16 and the protector 18 and enter an intake 22 of the pump 20. Fluids exit the pump 20 through a production tubing 24 that extends to the earth's surface, as is well known to those skilled in the art.

Extending from the earth's surface is an electrical power cable 26 that is operatively connected to the motor 16. The wellbore cable 26 is banded or strapped (not shown) to the production tubing 24 at intervals, such as every 100 to 200 feet, in order to transfer the weight of the cable 26 to the tubing 24 and thereby prevent the cable 26 from being stretched. In a typical wellbore application, almost the entire length of the cable 26 is of a round configuration, with a lower portion (such as 20 to 40 feet) of the cable is of a flat configuration, called a motor lead extension or "MLE". The reduced width of the MLE is used to enable the cable 26 to fit between the outer surface of the pump 20 and the inner surface of the casing 10. The clearances at this point in many wellbore applications are very tight, and at this point is where a majority of the abrasion or impact damage to the cable 26 occurs. For example, when the ESP 14 is started or stopped, the ESP 14 tends to rotate and move laterally due to torque reactions. Also, during operation, the inherent vibrations of the ESP 14 cause the ESP 14 to move within the casing 10. This is especially true for ESP's with progressive cavity pumps. The cable protector of the present invention is intended to protect the cable 26 at this location, as well as provide the desired vibration dampening.

One preferred embodiment of a cable protector 28 of the present invention comprises a generally tubular body 30 with a longitudinal bore 32 extending therethrough, for receiving therein the motor 16, protector 18 and/or the pump 20. The body 30 can be formed from a single piece of material or it can be formed from two or more housing members, as will be described in more detail below. The body 30 can be formed from a metal, such as a malleable low carbon steel or spring steel, a polymeric material, such as TEFLON or polyetheretherketone (PEEK), or preferably from an elastomeric material, such as highly saturated nitrile rubber.

An external surface 34 of the body 30 includes at least one channel 36 thereon into which is set the cable 26. In an alternate preferred embodiment, the channel 36 can be an indentation on an interior surface or a longitudinal bore through the body 30. The depth of the channel 36 is greater than the cable's diameter, if a round cable 26 is used, or is greater than the width of the cable, if a relatively flat MLE is used. In either case, the external surface 34 of the body 30 extends outwardly beyond the cable 26 so as to protect the cable 26 from abrasion and/or impact damage caused by the cable 26 and/or the ESP 14 coming into contact with the casing 10. To retain the cable 26 within the channel 36 and, if desired, to attach the cable protector 28 to the ESP 14, one or more straps or bands 38 extend around the body 30, and are pinned, riveted, crimped, bolted or glued in position. The manner by which the cable 26 is retained within the channel 36 is not as important as the need for the channel 36 to have appropriate dimensions and a configuration to extend outwardly beyond the cable 26. In addition, the straps 38 need to be affixed to the body 30, and the body 30 connected to the ESP 14 by means with minimized outer dimensions. As can be understood from the foregoing discussion, the cable protector 28, as shown in FIG. 1, provides damage protection of the cable 26 with the needed minimized dimensions not found in prior cable protectors or anchors.

An alternate preferred embodiment of a cable protector 28 of the present invention is shown in FIG. 2, and includes a generally tubular body formed from at least two body members 40, each having a curved inner surface adapted to be placed against the ESP 14, and a curved outer surface 42. At least one end of one or both body members 40 includes suitable means for connection of the body members 40 one to the other. The body members 40 can be connected together by means of glue, pins, or preferably by means of a hinge 44 that enables the cable protector 28 to be easily opened and then closed around the ESP 14.

At least one longitudinal protrusion or rib 46 extends outwardly from the external surface 42 of one or both of the body members 40. The height (or outward extent) of the protrusion 46 is greater than the cable's diameter, if a round cable is used, or is greater than the width of the cable, if a relatively flat MLE is used. The area on the external surface 42 immediately along the side of the protrusion 46 defines a "channel" 48 within which the cable 26 is retained and protected. In all cases, an external surface of the protrusion 46 extends outwardly beyond the cable 26 so as to protect the cable 26 from abrasion and/or impact damage caused by the cable 26 and/or the ESP 14 coming into contact with the casing 10.

To minimize the outer dimensions of the cable protector 28, and to protect the straps 38 themselves from abrasion and/or impact damage, one or more of the body members 40 include at least one lateral indentation 50 within which the straps 38 are received. Also, one or more of the protrusions 46 can include at lone lateral indentation 52 within which the straps 38 are received. Again, the depth of the indentations 50 and 52 should be equal to or greater than the thickness of the straps 38, so that only the body member 40 comes into contact with the casing 10.

Figure 3:
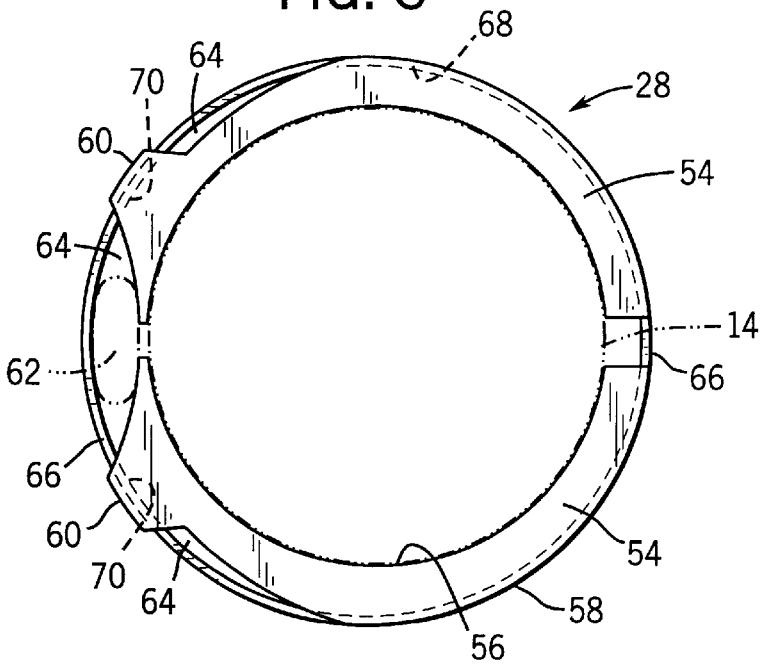
FIGS. 3–5 are end views of alternate preferred embodiments of cable protectors of the present invention.

FIG. 3 shows an alternate preferred embodiment of the cable protector 28 of the present invention, similar in appearance to the embodiment shown in FIG. 2. In this embodiment, the cable protector 28 is formed from two body members 54, which are mirror images, and which can be, but are not shown as being, connected. An inner surface 56 of each body member 54 is curved to fit against the ESP 14, and an outer surface 58 of each body member 54 is curved to fit within the casing 10. At least one longitudinal protrusion or rib 60 extends outwardly from the external surface 58 of the body members 54. The height (or outward extent) of the protrusions 60 is greater than the cable's diameter, if a round cable is used, or is greater than the width of a cable 62, if a relatively flat MLE is used. The area on the external surface 58 immediately along the sides of the protrusions 60 and between the protrusions 60 defines one or more "channels" 64 within which one or more of the cables 62 are retained and protected. In all cases, an external surface of the protrusions 60 extend outwardly beyond the cable 62 so as to protect the cable 62 from abrasion and/or impact damage.

To retain the cable 62 within the channel 64, and, if desired, to attach the cable protector 28 to the ESP 14, one or more straps or bands 66 extend around the body members 54, and are pinned, riveted, crimped, bolted or glued in position. To minimize the outer dimensions of the cable protector 28, and to protect the straps 66 themselves from abrasion and/or impact damage, one or more of the body members 54 include at least one lateral indentation 68 within which the straps 66 are received. Also, one or more of the protrusions 60 can include at least one lateral indentation 70 within which the straps 66 are received. Again, the depth of the indentations 68 and 70 should be equal to or greater than the thickness of the straps 66, so that only the body member 54 comes into contact with the casing 10.

Figure 4:
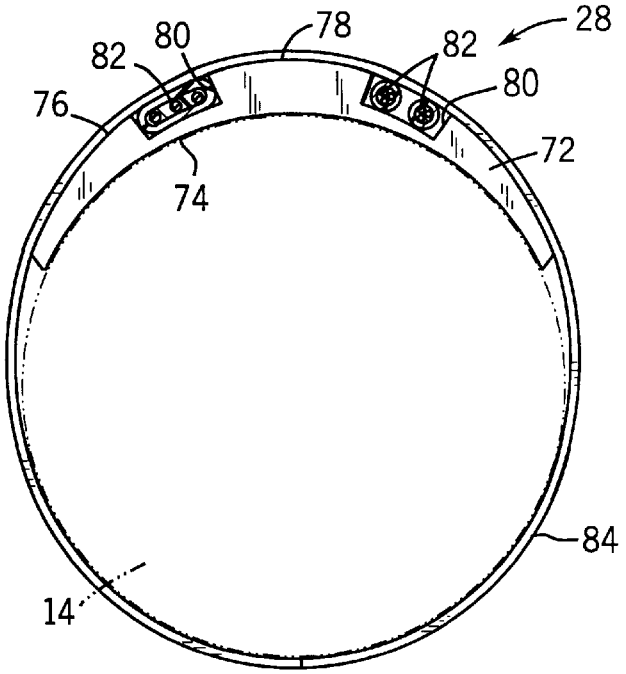

FIG. 4 shows an alternate preferred embodiment of the cable protector 28 of the present invention, similar in appearance to the embodiment shown in FIG. 3. In this embodiment, the cable protector 28 is formed from a single body member 72. An inner surface 74 of the body member 72 is curved to fit against the ESP 14, and an outer surface 76 of the body member 72 curved to fit within the casing 10. The body member 72 is relatively short in that it does not extend fully or at least a major portion of the way around the ESP 14. The body member 72 has a thickness that can be constant across its lateral extent or its thickness can increase towards a middle portion 78, as shown in FIG. 4. The body member 72 includes one or more longitudinal indentations or channels 80, into which are received one or more cables 82. The channels 80 can be defined as the "valleys" between portions of the body member 72 of increased thickness. In other words, the body member 72 may not have defined protrusions or ribs, as in the embodiments discussed above, but its shape and configuration can provide the same benefits of protection for the cable 82. As before, the external surface 76 extends outwardly beyond the cable 82, so as to protect the cable 82 from abrasion and/or impact damage.

To retain the cable 82 within the channels 80, and, if desired, to attach the cable protector 28 to the ESP 14, one or more straps or bands 84 extend around the body member 72 and the ESP 14, and are pinned, riveted, crimped, bolted or glued in position. To minimize the outer dimensions of the cable protector 28, and to protect the straps 84 themselves from abrasion and/or impact damage, at least a portion of the body member 72 includes at least one lateral indentation (not shown) within which the straps 84 are received. Again, the depth of the indentations should be equal to or greater than the thickness of the straps 84, so that only the body member 72 comes into contact with the casing 10.

Figure 5:
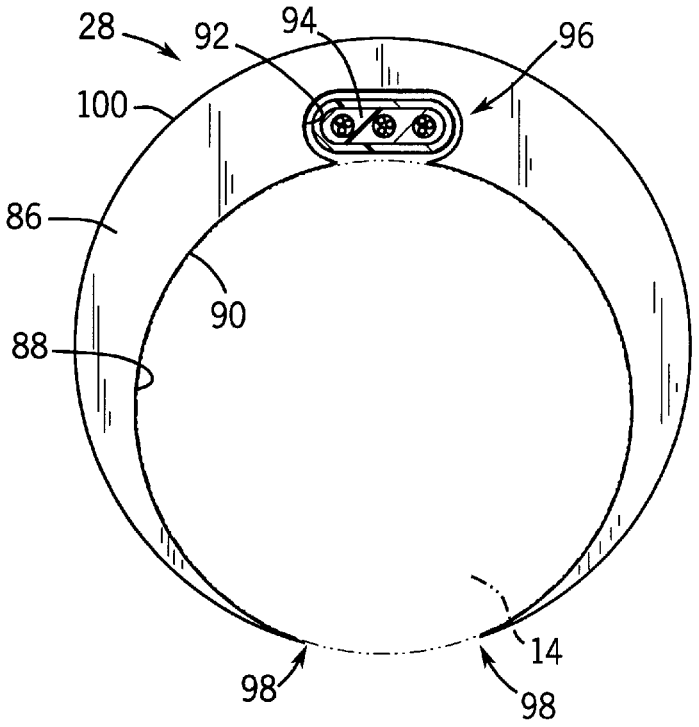

FIG. 5 shows an alternate preferred embodiment of the cable protector 28 of the present invention. In this embodiment, a body member 86 is formed from one or more pieces, and preferably is a single piece of molded or extruded polymeric material or nitrile rubber. A longitudinal bore 88 extends through the body member 86, with the center line of the bore 88 offset from the center line of the body member 86. An interior surface 90 of the body member 86 includes one or more longitudinal indentations or channels 92, adjacent a relatively thick portion 96 thereof, into which is received a cable 94. In one preferred embodiment (not shown) one or more longitudinal openings extend through the relatively thick portion 96, and do not necessarily communicate with the longitudinal bore 88. As before, the dimensions and configuration of the channel 92 are selected to ensure that the cable 94 is protected from damage.

The body member 86 is either slid over the ESP 14 if it is formed from a continuous ring of material, or if it is merely a crescent-shape, then its open ends 98 are pried apart and the cable 94 and the ESP 14 inserted therein. The body member 86 can be attached to the ESP 14 by friction, such as having the diameter of the bore 88 approximately equal to the diameter of the ESP 14. Alternatively, the body member 86 is glued or strapped to the ESP 14. If straps (not shown) are used, then an external surface 100 of the body member 86 can include one or more annular indentations (not shown) within which the straps can be received to minimize the outer dimensions of the cable protector 28.

Figure 6:
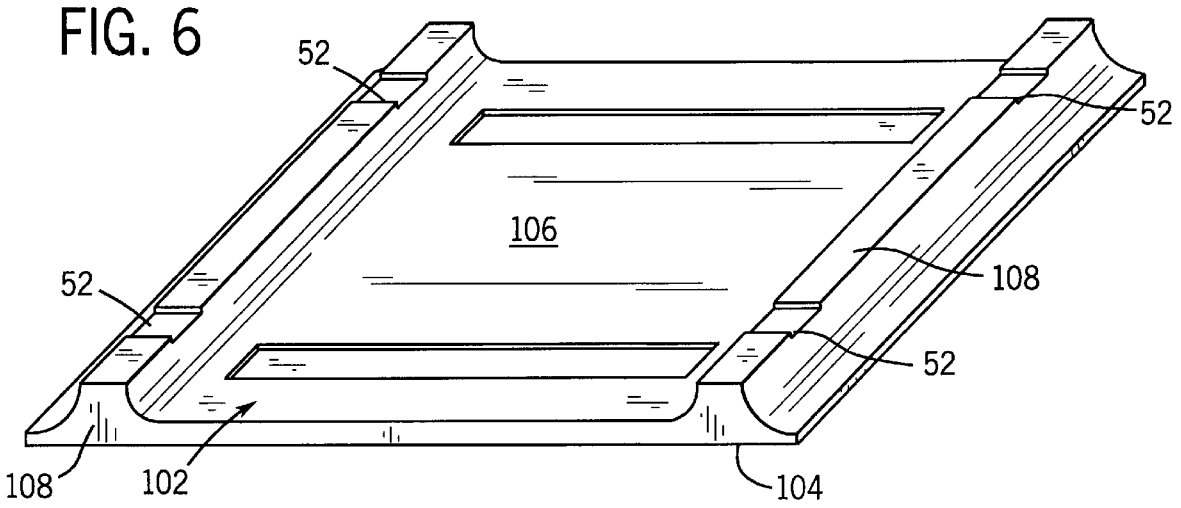
FIG. 6 is a perspective view of an alternate preferred embodiment of a cable protector of the present invention.
Figure 7:
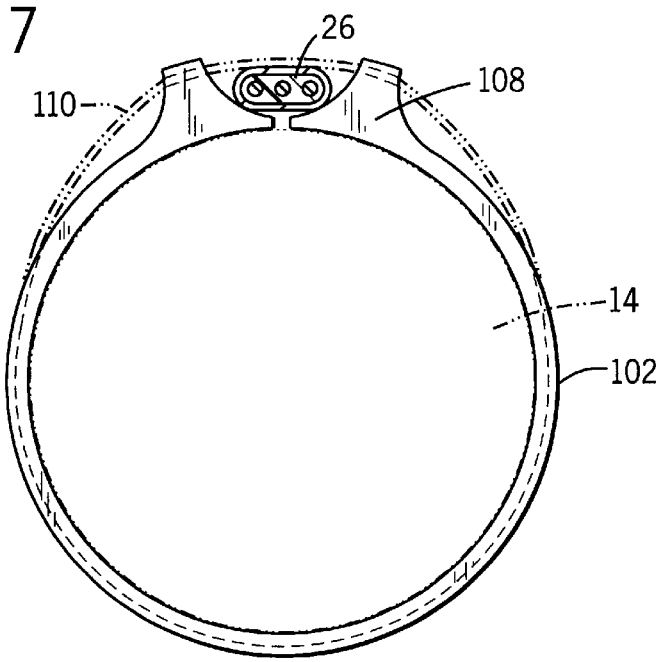
FIG. 7 is an end view of the cable protector of FIG. 6.

FIGS. 6 and 7 show an alternate preferred embodiment of a cable protector of the present invention. In this embodiment a body member 102 is formed by molding as a generally flat body from one or more layers of elastomeric material, such as highly saturated nitrile rubber. The body member 102 has a generally flat underside or internal surface 104 that is wrapped against the ESP 14, and external surface 106 with at least one protrusion 108 thereon next to or between (if two) is set the cable 26. In an alternate preferred embodiment, the cable channel can be an indentation on the external surface 106. The depth of the channel, i.e., the height of the protrusion(s) 108, is greater than the cable's diameter, if a round cable is used, or is greater than the width of the cable, if a relatively flat MLE is used. To retain the cable 26 within the channel and, if desired, to attach the body member 102 to the ESP 14, one or more straps or bands 110 extend around the body member 102, and are pinned, riveted, crimped, bolted or glued in position.

It should be understood that each of the preferred embodiments of cable protectors of the present invention can be made from forged or cast or molded metallic materials, such as malleable carbon steel or resilient spring steel. In addition, the cable protectors can be made from one or more layers of thermoplastic or thermoset materials, such as PEEK, and/or elastomeric materials to provide the desired low cost and vibration dampening. Suitable elastomeric materials include polyisoprene, styrene-butadiene copolymers, polybutadiene, ethylene propylene diene methylene, polychloroprene, acrylonitrile butadiene copolymer, highly saturated acrylonitrile butadiene copolymer, tetrafluoroethylene propylene copolymer, vinylidene fluoride hexafluoropropylene copolymer, and mixtures, blends and alloys of the above.

Whereas the cable protectors have been individually described above, it should be understood that one or more of the distinct features of one preferred embodiment of a cable protector described above, can be used on other of the preferred embodiments or can be combined to form new embodiments not shown herein.

Wherein the present invention has been described in particular relation to the drawings attached hereto, it should be understood that other and further modifications, apart from those from those shown or suggested herein, may be made within the scope and spirit of the present invention.

What is claimed:

1. A conduit protector for use within a wellbore, comprising:

a body member adapted to be mounted about a wellbore device;

the body member being formed from an elastomeric material; and the body member having at least one generally longitudinal channel for receiving a conduit therein, wherein the body member is flexible to permit it to be moved between a generally flat position and a position wrapped about the wellbore device.

2. A conduit protector of claim 1 wherein the elastomeric material comprises a highly saturated nitrite rubber.

3. A conduit protector of claim 1 wherein the longitudinal channel is defined by a protrusion.

4. A conduit protector of claim 1 wherein the body member includes a pair of protrusions that define the longitudinal channel.

5. A conduit protector of claim 4 wherein the pair of protrusions extend radially outward when the body member is mounted on the wellbore device.

6. A conduit protector of claim 1 and further comprising a mechanism for attaching the body member to the wellbore device.

7. A conduit protector of claim 6 wherein the mechanism for attaching comprises at least one strap.

8. A conduit protector of claim 1 wherein the body member includes an indentation for receiving an at least one strap.

9. A conduit protector of claim 1 wherein the depth of the longitudinal channel is greater than the width of a conduit.

10. A cable protector for use within a wellbore, comprising:

a protector body comprising at least one housing member having a concave inner surface adapted to be placed against a wellbore device, and a generally curved outer surface;

the protector body having at least one longitudinal protrusion extending therefrom adapted to receive a cable adjacent to or between the protrusions, with a width between the protrusions being greater than a lateral dimension of the cable and a height of the protrusions being greater than a width of the cable; and a pair of straps extending around the protector body to attach the protector body to the wellbore device and to retain the cable between and inwardly of the protrusions, wherein the protector body has a pair of indentations along at least a portion of the generally curved outer surface to receive the pair of straps.

11. A cable protector of claim 10 wherein the protector body comprises an elastomeric material.

* * * * *